US005239703A

United States Patent [19]

Nordin et al.

[11] Patent Number: 5,239,703

[45] Date of Patent: Aug. 31, 1993

[54] POSITIONABLE VISOR ARRANGEMENT

[75] Inventors: Henrik Nordin, Forsheda; Jan-Olof Fag, Varnamo, both of Sweden

[73] Assignee: Peltor Aktiebolag, Sweden

[21] Appl. No.: 942,711

[22] Filed: Sep. 9, 1992

[30] Foreign Application Priority Data

Sep. 11, 1991 [SE] Sweden ..... 9102624

[51] Int. Cl.[5] ..... A61F 9/06; A42B 3/22

[52] U.S. Cl. ..... 2/10; 2/424; 403/119

[58] Field of Search ..... 2/424, 10, 11, 453, 2/13, 9, 422, 410; 403/93, 119, 291, 375

[56] References Cited

U.S. PATENT DOCUMENTS 4,222,123 9/1980 Hellberg ..... 2/10

4,224,694 9/1980 Palmaer ..... 2/422

FOREIGN PATENT DOCUMENTS 8603656 7/1986 PCT Int'l Appl. ..... 2/10

*Primary Examiner*—Clifford D. Crowder

*Assistant Examiner*—Michael A. Neas

*Attorney, Agent, or Firm*—Ostrolenk, Faber, Gerb & Soffen

[57] ABSTRACT

The visor arrangement of the present invention includes a visor element and support apparatus to support the element in a pivotable state between a lowered, operative position and a raised, inoperative position on a protective helmet or other holder which can be applied on the user's head. The support apparatus is a pair of support arms, each consisting of two detachably connectable parts pivotable in relation to each other. One of the parts is provided with a laterally protruding journalling-pin element, while the other is provided with a laterally running through-opening into which the journalling pin can be inserted. The pin, due to the action of flange members arranged at its free ends and protruding laterally, is detachably retained in a state with limited pivotability about a first pivot point defined by a first longitudinal part hereof, to be turned about this point between two predetermined, stable positions corresponding to the two stated positions of the visor element, during displacement of an opposite second longitudinal part of the journalling-pin element along an abutting flexible wall portion of the opening. This second longitudinal part of the journalling-pin element defines a second pivot point for the journalling-pin element about which this can be turned from one of the two predetermined positions to a free position in which it can be removed from the opening.

3 Claims, 1 Drawing Sheet

POSITIONABLE VISOR ARRANGEMENT

BACKGROUND TO THE INVENTION

In a previously known arrangement of this type the support-arm part in which the journalling opening is arranged has two flexible shanks, engaging each other by means of hooked portions and pivotable in relation to each other, said shanks forming a journalling opening between them and an open gap, communicating with the opening, between the opposite free end portions of the two shanks, through which a gap the journalling-pin element can be inserted into the journalling opening and removed therefrom by moving it sideways, i.e. at right angles to the longitudinal direction of the bearing-pin element. The desired spring mobility between the two shanks necessitates an extremely complicated construction of the support arm portion itself. Furthermore, it is provided with a covering plate in the form of a separate element applied on one side. This support-arm part is therefore expensive to manufacture. The design is also such that it is easily damaged if the visor arrangement is treated roughly.

OBJECTS OF THE INVENTION

A principle object of the invention is to provide an improved visor arrangement of the type mentioned, which eliminates the drawbacks described above inherent in the known arrangement.

In accordance with the foregoing objects this invention provides a positionable visor arrangement according to the preamble of claim 1, wherein the journalling opening is unbroken and the opening is at least substantially triangular in shape, having two shorter side walls of equal length and a corner located between them against which the first longitudinal part of the journalling-pin element is arranged to abut during pivoting between said two predetermined positions, and a longer side wall located opposite this corner and forming said flexible wall portion of the opening and being sufficiently long to permit the journalling-pin element, once it has been turned to its free position, to be withdrawn from the opening in its longitudinal direction without being impeded by said flange members.

According to a suitable embodiment of the invention the opening has rounded corners.

According to the invention the corner located between the two shorter side walls of the opening may have a considerably smaller radius than the other two corners.

DESCRIPTION OF THE DRAWINGS

Additional characteristics of the invention are revealed in the following description in which the invention is described more clearly with reference to the accompanying drawings in which.

Figure 1:
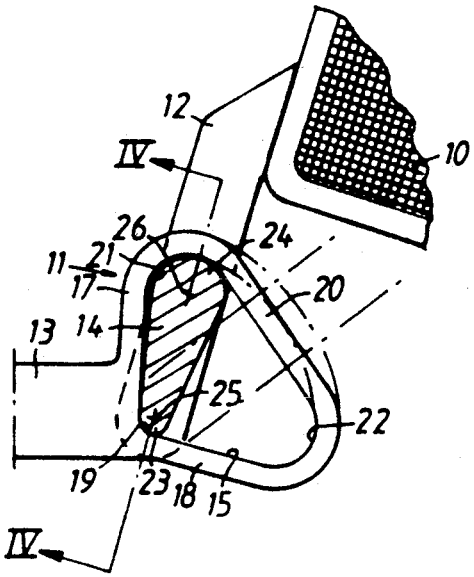
FIG. 1 shows a partial side view of a visor arranged according to an embodiment of the invention selected by way of example, with the visor element in a raised, inoperative position, FIG. 2 also shows a partial side view of the arrangement with the visor element in its lowered, operative position.
Figure 2:
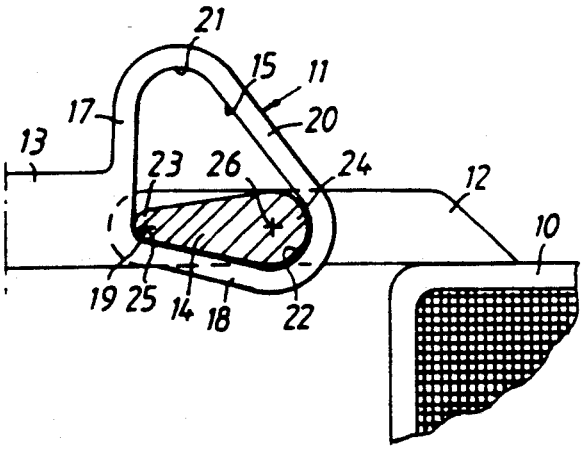
Figure 3:
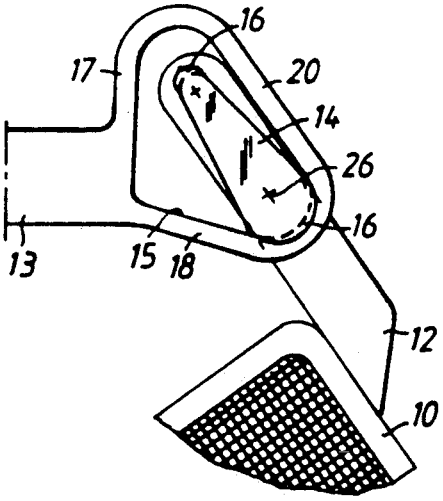
FIG. 3 is another partial side view of the arrangement with the visor element in a free position in which it can be removed from, for instance, a protective helmet or a holder therefor.

The visor arrangement illustrated in the drawings comprises a partially shown visor element 10 and two support arms joined to it by their upper side sections, only one of which is however shown in the drawing. The other support arm, not visible in FIGS. 1 3, is supported as shown for the support arm 11 but preferably as a mirror reflection thereof. The support arms serve to carry the visor element in pivotable state between a raised, inoperative position as shown in FIG. 1 and a lowered, operative position as shown in FIG. 2, on a protective helmet or other holder which can be applied on the user's head.

Figure 4:
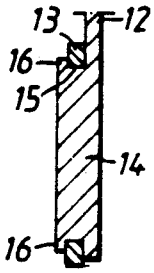
FIG. 4 is a detailed view in section along the line IV—IV in FIG. 1.

Each support arm 11 consists of two detachably connectable parts 12 and 13, pivotable in relation to each other, the part 12 being secured to the visor element 10 whereas the part 13 is secured to said holder. The support-arm part 12 is provided on one side with laterally protruding journalling-pin element 14, while the support-arm part 13 is provided with a through-opening 15 running in lateral direction, into which the journalling-pin element 14 can be inserted and is detachably retained therein with the aid of laterally protruding flanges 16 arranged at the free ends of this element (see FIGS. 3 and 4).

The circumference of the journalling opening 15 is unbroken and the opening is at least substantially triangular in shape, having two shorter side walls 17 and 18 of equal length with a rounded corner 19 located between them and a longer side wall 20 located opposite this corner and forming a flexible wall portion of the opening 15. The corners 21 and 22 joining the side wall 20 to the side walls 17 and 18, respectively, are also rounded. However, the radius of curvature of these corners is considerably larger than that of the corner 19.

Seen in cross section, the journalling-pin element 14 has an oval, wedge-like shape with a first, longitudinally running, rounded part 23 having relatively small radius of curvature and an opposite longitudinally running, rounded part 24 having considerably large radius of curvature. These two longitudinal parts 23 and 24 of the journalling element 14 define pivot points 25 and 26, respectively therefor.

The shape of the journalling-pin element 14 is such in relation to the opening 15 that when its part 23 is in contact with the corner 19 in the opening 15, as shown in FIGS. 1 and 2, it can be turned about the pivot point 25 defined by this part between two predetermined, stable positions as shown in FIGS. 1 and 2, the part 24 being moved along the side wall 20, the latter then being in spring contact with said part. The visor element 10 can thus be swung between and detachably retained in the two positions shown in FIGS. 1 and 2. The spring flexibility of the side wall 20 is shown in FIG. 1 by indicating this wall, the support-arm part 12 and the journalling-pin element 14 in broken lines in an intermediate position during passage from the position shown in FIG. 1 to that shown in FIG. 2. At least the part of the support-arm part 13 forming the opening 15 should be made of a material having suitable elasticity in order to achieve said spring flexibility.

From the position shown in FIG. 2 the visor element 10 can be swung to the position shown in FIG. 3 by turning the journalling-pin element 14 in the opening 15 about the pivot point 26 defined by the part 24. The journalling-pin element 14 will then assume a free position in which it can be withdrawn from the opening in its longitudinal direction after having been displaced a short distance diagonally upwards and to the left in FIG. 3 so that the two flanges 16 can pass freely through the opening. The two support-arm parts 12 and 13 can thus easily be disconnected enabling the visor element 10 to be removed, if desired, from the protective helmet or other holder therefor.

The invention is not limited to the embodiment described above and shown in the drawings. It can instead be modified in several ways within the scope of the inventive concept. The journalling-pin element 14, for instance, may be formed of two cylindrical pins spaced from each other and protruding from the support-arm part 12, each forming one of the pivot points 25 or 26. Additional positions may also be set for the visor arrangement by providing the side wall 20, for instance, with stud members such as protrusions or the like.

We claim:

1. A visor arrangement comprising a visor element and support means to support said element in a pivotable state between a lowered, operative position and a raised, inoperative position on a protective helmet or other holder which can be applied on the user's head, 'said support means comprising a pair of support arms, each support arm consisting of two detachably connectable parts pivotable in relation to each other, one of said parts is provided with a laterally protruding journalling-pin element, while the other of said parts is provided with a laterally running through-opening into which the journalling pin can be inserted, said journalling pin, due to the action of flange members arranged at its free ends and protruding laterally therefrom, is detachably retained in a state with limited pivotability about a first pivot point defined by a first longitudinal part thereof, to be turned about this point between two predetermined, stable positions corresponding to the two stated positions of the visor element, during displacement of an opposite second longitudinal part of the journalling-pin element along an abutting flexible wall portion of the opening, this second longitudinal part of the journalling-pin element defining a second pivot point for the journalling-pin element about which this can be turned from one of said two predetermined positions to a free position in which it can be removed from the opening, characterized in that the circumference of the opening is unbroken and the opening is substantially triangular in shape having two shorter side walls of equal length and a corner located between them against which the first longitudinal part of the journalling-pin element is arranged to abut during pivoting between said two predetermined positions, and a longer side wall located opposite this corner and forming said flexible wall portion of the opening and being sufficiently long to permit the journalling-pin element, once it has been turned to its free position, to be withdrawn in its longitudinal direction from the opening without being impeded by said flange member.

2. A visor arrangement as claimed in claim 1, characterized in that the opening has rounded corners.

3. A visor arrangement as claimed in claim 2, characterized in that the corner located between the shorter side walls of the opening has a considerably smaller radius than the other two corners.

* * * * *